US009382082B2

(12) United States Patent
Imoto

(10) Patent No.: US 9,382,082 B2
(45) Date of Patent: Jul. 5, 2016

(54) SHEET CONVEYING DEVICE AND IMAGE FORMING APPARATUS CAPABLE OF CONVEYING A SHEET ABSORBED WITH AN ELECTRIC CHARGE

(71) Applicant: Shinji Imoto, Setagaya-ku (JP)

(72) Inventor: Shinji Imoto, Setagaya-ku (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/482,864

(22) Filed: Sep. 10, 2014

(65) Prior Publication Data

US 2015/0070456 A1 Mar. 12, 2015

(30) Foreign Application Priority Data

Sep. 12, 2013 (JP) ..... 2013-189055
Jun. 18, 2014 (JP) ..... 2014-124987

(51) Int. Cl.

| | |
|---|---|
| ***B65H 5/00*** | (2006.01) |
| ***B41J 11/00*** | (2006.01) |
| ***B65H 29/60*** | (2006.01) |
| ***B65H 5/02*** | (2006.01) |
| ***B65H 29/14*** | (2006.01) |
| ***B65H 29/16*** | (2006.01) |
| ***B65H 85/00*** | (2006.01) |

(52) U.S. Cl.

CPC ..... *B65H 5/004* (2013.01); *B41J 11/007* (2013.01); *B65H 5/021* (2013.01); *B65H 29/14* (2013.01); *B65H 29/16* (2013.01); *B65H 29/60* (2013.01); *B65H 85/00* (2013.01); *B65H 2301/33312* (2013.01); *B65H 2301/4473* (2013.01); *B65H 2301/44324* (2013.01); *B65H 2301/5133* (2013.01); *B65H 2301/5322* (2013.01); *B65H 2404/254* (2013.01); *B65H 2404/2531* (2013.01)

(58) Field of Classification Search
None
See application file for complete search history.

(56) References Cited

U.S. PATENT DOCUMENTS

| | | | |
|---|---|---|---|
| 7,334,858 | B2 | 2/2008 | Kogure et al. |
| 7,434,927 | B2 | 10/2008 | Sakuma et al. |
| 7,591,551 | B2 | 9/2009 | Imoto et al. |
| 7,621,632 | B2 | 11/2009 | Imoto et al. |
| 7,682,016 | B2 | 3/2010 | Sakuma et al. |
| 7,731,322 | B2 | 6/2010 | Kogure et al. |
| 7,891,805 | B2 | 2/2011 | Imoto et al. |
| 8,029,126 | B2 | 10/2011 | Imoto |
| 8,043,016 | B2 | 10/2011 | Kogure et al. |
| 8,295,733 | B2 | 10/2012 | Imoto |
| 8,684,487 | B2 | 4/2014 | Imoto |
| 2009/0052917 | A1 | 2/2009 | Kogure et al. |

FOREIGN PATENT DOCUMENTS

| | | |
|---|---|---|
| JP | H07-133035 | 5/1995 |
| JP | 2006-076270 | 3/2006 |
| JP | 2010-150017 | 7/2010 |

OTHER PUBLICATIONS

U.S. Appl. No. 14/190,261, Imoto.

*Primary Examiner* — An Do
*Assistant Examiner* — Renee I Wilson
(74) *Attorney, Agent, or Firm* — Oblon, McClelland, Maier & Neustadt, L.L.P.

(57) ABSTRACT

A sheet conveying device and an image forming apparatus include a conveying member that adsorbs a sheet by an electric charge and conveys the sheet, a first electric charger to charge the conveying member by applying voltage, and a second electric charger to charge the conveying member by applying voltage. The second electric charger is arranged downstream from the first electric charger in a conveying direction, and applies the electric charge with the same polarity as the first electric charger to the conveying member.

9 Claims, 11 Drawing Sheets

SHEET CONVEYING DEVICE AND IMAGE FORMING APPARATUS CAPABLE OF CONVEYING A SHEET ABSORBED WITH AN ELECTRIC CHARGE

CROSS-REFERENCE TO RELATED APPLICATIONS

This patent application is based on and claims priority pursuant to 35 U.S.C. §119 to Japanese Patent Application Nos. 2013-189055, filed on Sep. 12, 2013, and 2014-124987, filed on Jun. 18, 2014, in the Japan Patent Office, the entire contents of each of which are hereby incorporated by reference herein.

BACKGROUND

1. Technical Field

Embodiments discussed herein relate to a conveying device or an image forming apparatus, and in particular, to a conveying device and an image forming apparatus capable of conveying a sheet absorbed with an electric charge.

2. Related Art

As an image forming apparatus, such as a printer, a facsimile machine, a copier, a plotter, a multifunctional machine combining these capabilities, etc., an ink-jet printer that employs a droplet ejecting-type printing system with a droplet discharging head that ejects the droplet is known.

In such an image forming apparatus, a droplet having landed on a printing medium takes a long time to dry and form an image thereon. For this reason, the printing medium is conveyed with its image forming surface distanced from (i.e., not contacting) a sheet conveying device until the droplet on the printing medium dries.

Certain known conveying systems convey the printing medium using electrostatic force generated in a sheet conveying device to attract the printing medium.

However, it is not possible to apply an electric charge of a required quantity on the conveying member for the generation of electrostatic force, when the environment changes, especially in low-temperature and low-humidity environments.

In detail, to increase the charge quantity on the conveying member, it is necessary to increase the applied voltage or the applied current. However, increasing the applied voltage causes damage to the conveying member by spark discharge from a charging unit. Moreover, reducing the resistance of the charging unit to increase the applied current causes generation of unstable potential to the conveying member.

SUMMARY

Accordingly, one aspect of the present disclosure provides a sheet conveying device and an image forming apparatus using the sheet conveying device that include a conveying member that adsorbs the sheet by an electric charge electrified on the surface, and at least two electric chargers to charge the conveying member, each charger applying a charge of the same polarity to the conveying member.

BRIEF DESCRIPTION OF THE DRAWINGS

A more complete appreciation of the present invention and the advantages thereof will be understood by reference to the following detailed description, when considered in connection with the accompanying drawings. In the drawings.

DETAILED DESCRIPTION

Figure 1:
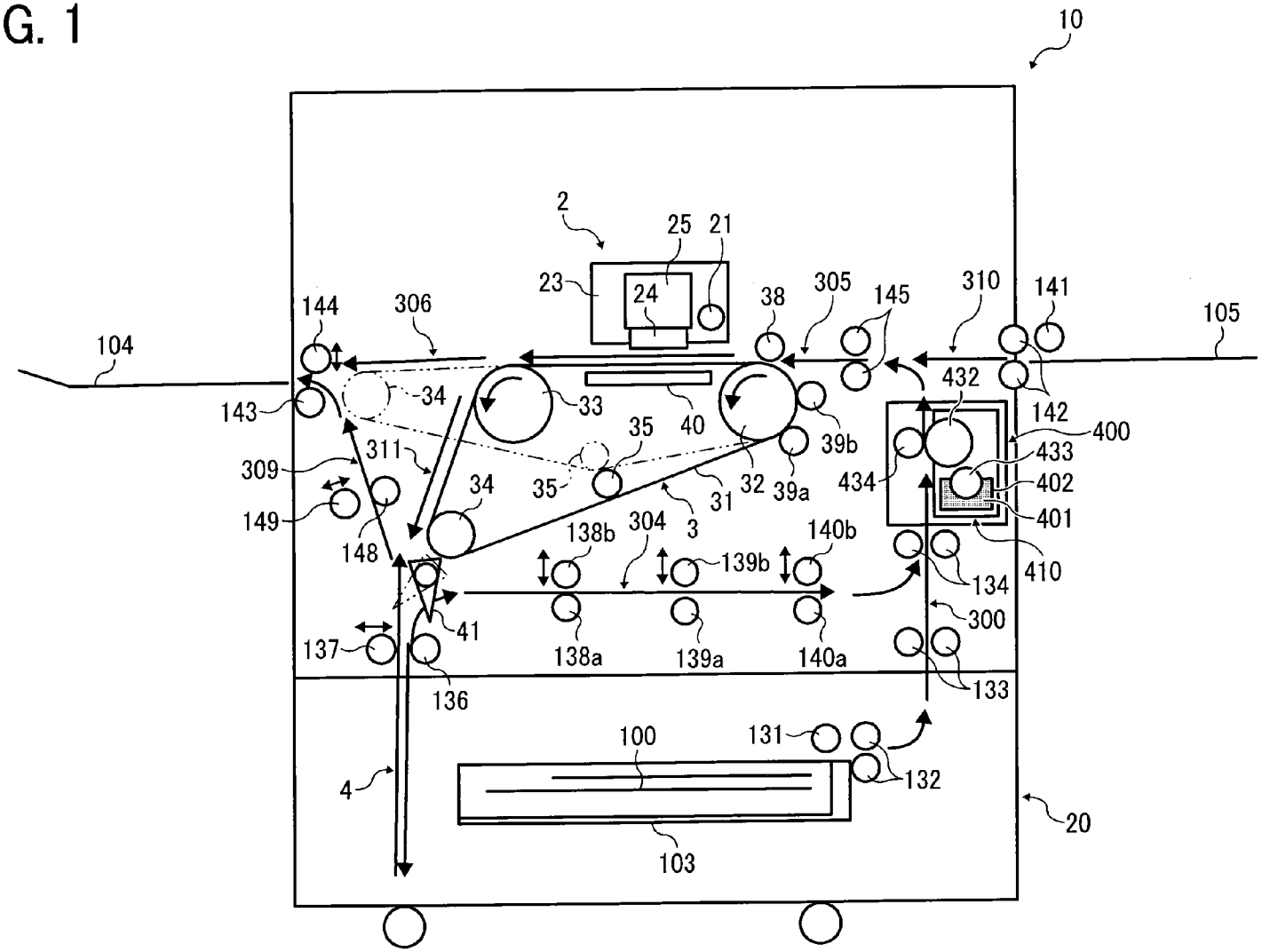
FIG. 1 is a diagram illustrating the overall configuration of an exemplary image forming apparatus according to one embodiment of the present disclosure.
Figure 2:
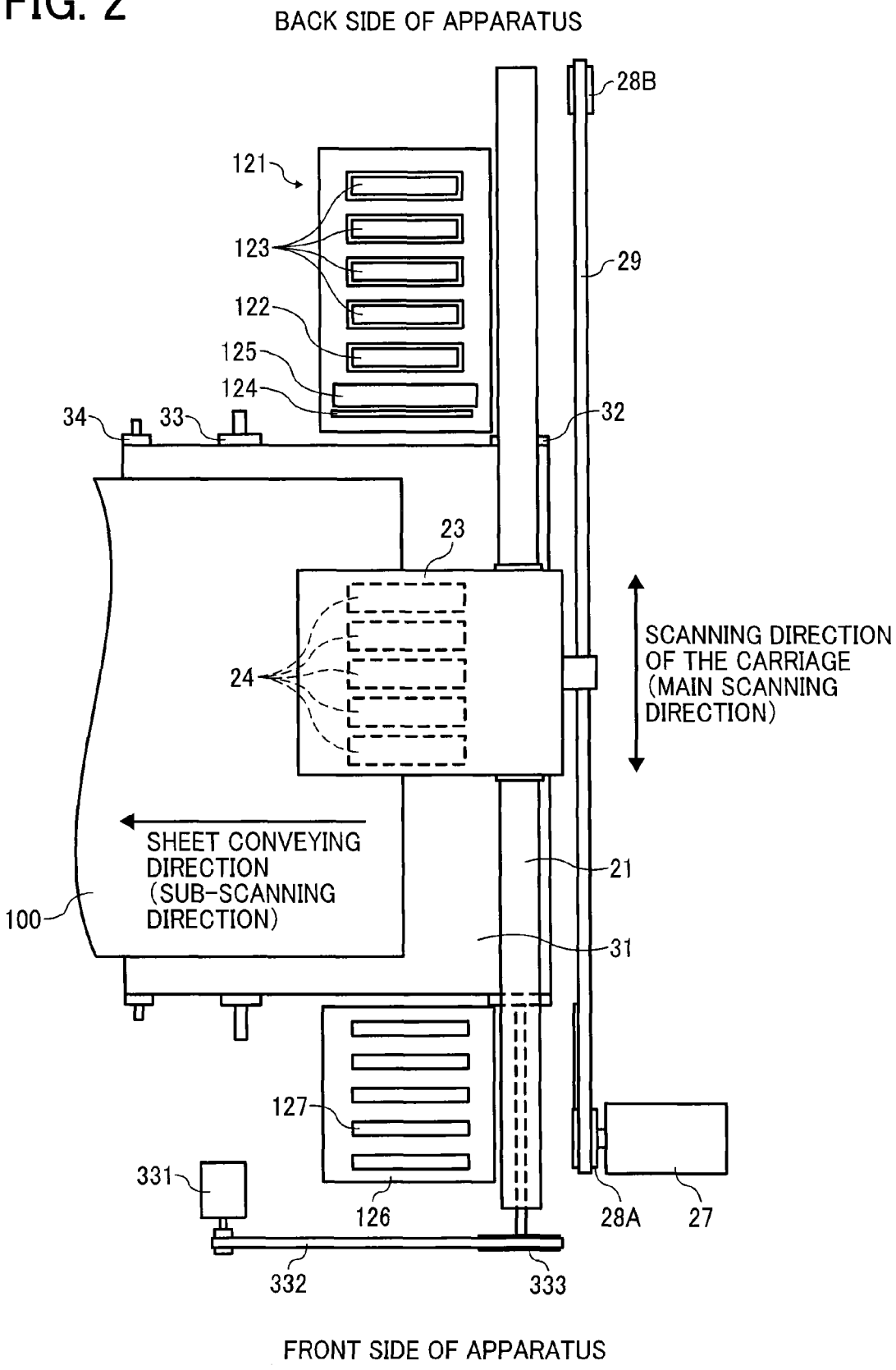
FIG. 2 is a schematic plan view illustrating a mechanism included in the image forming apparatus of FIG. 1 according to one embodiment of the present disclosure.
Figure 3:
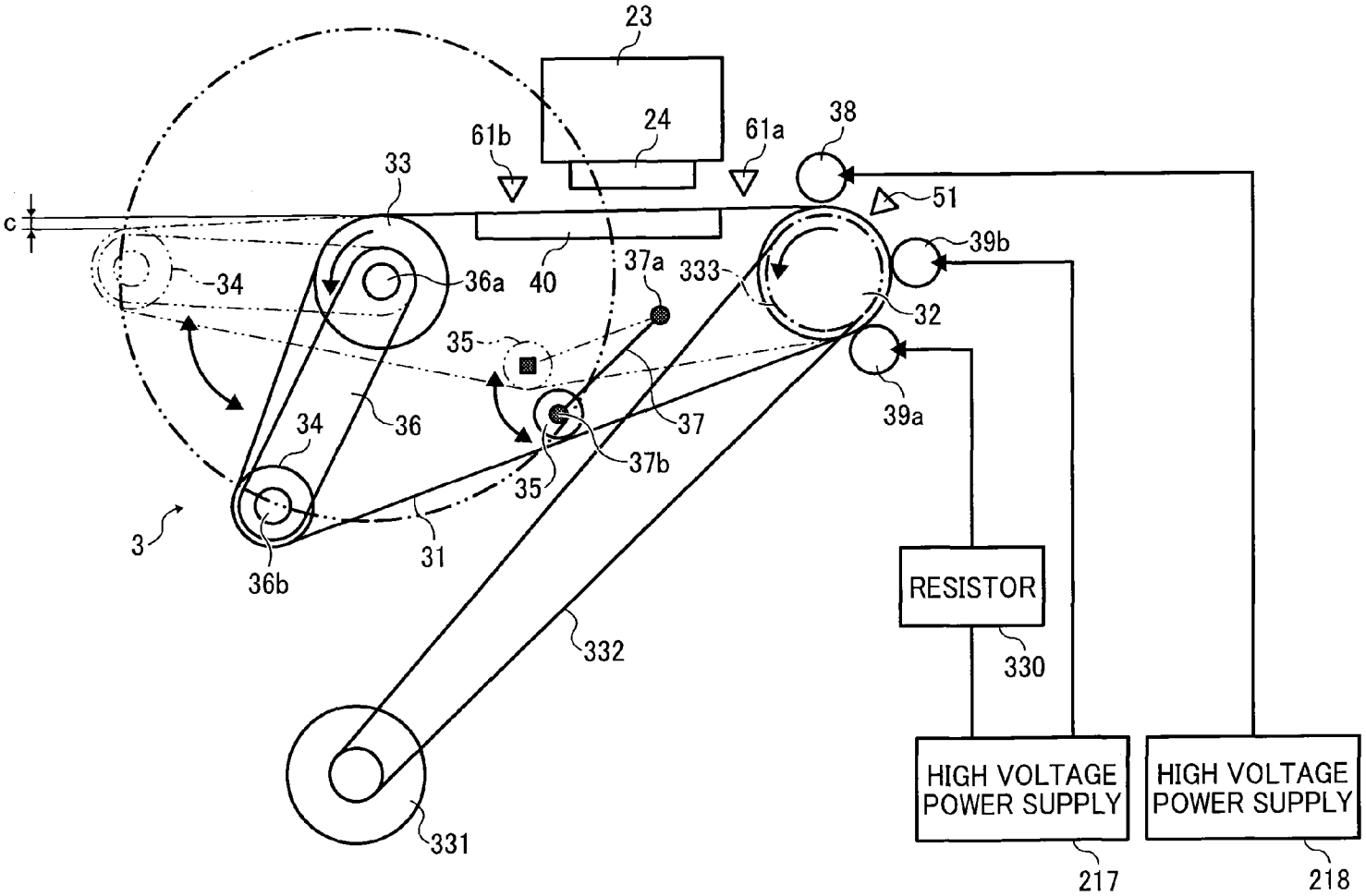
FIG. 3 is a side view illustrating a sheet conveying unit disposed in the image forming apparatus of FIG. 1 according to one embodiment of the present disclosure.
Figure 4:
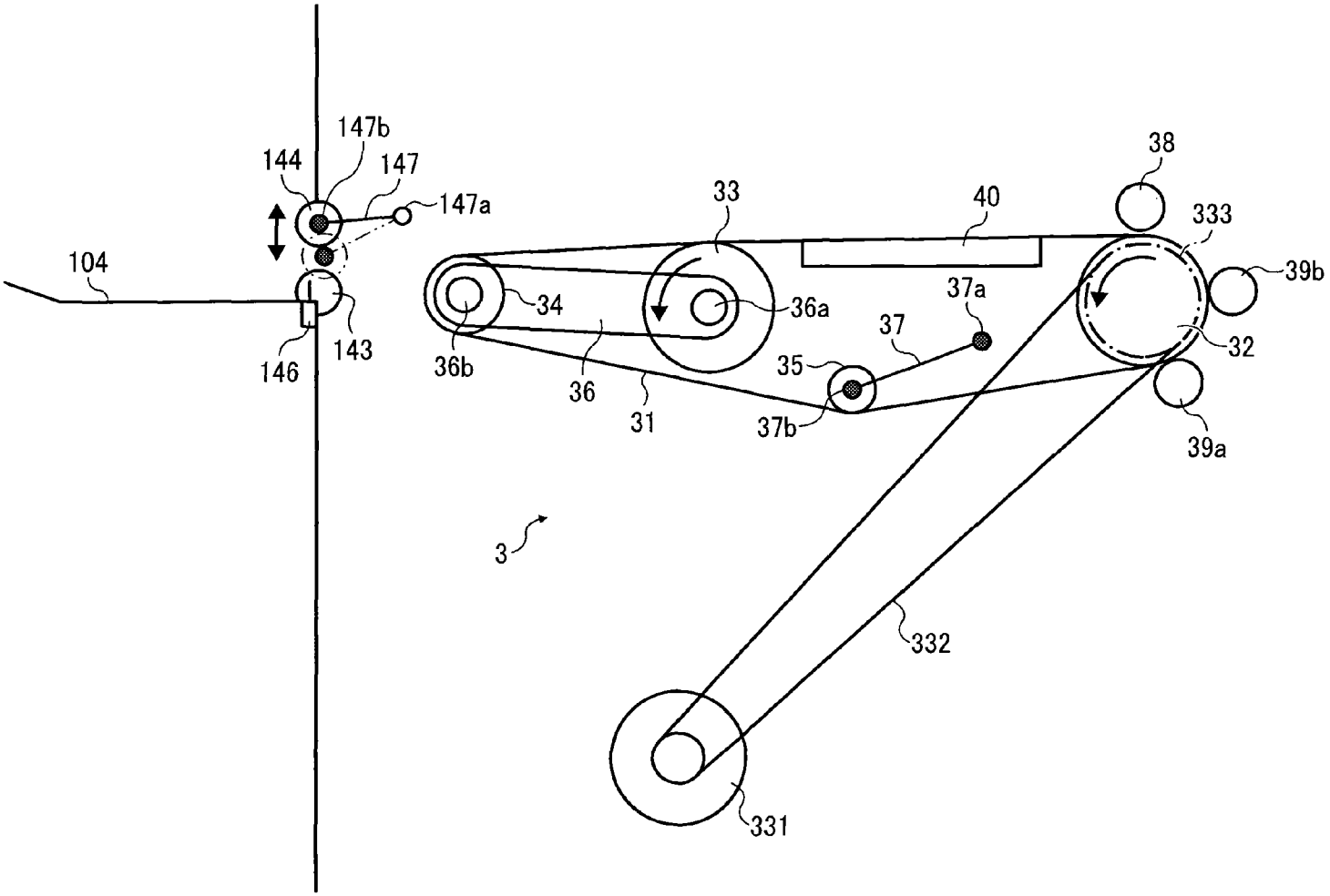
FIG. 4 is a diagram illustrating both an aspect of the image forming apparatus of FIG. 1 and another mechanism provided in the image forming apparatus to engage and disengage a driven roller with a driving roller when a sheet is linearly ejected therefrom according to one embodiment of the present disclosure.

Referring now to the drawings, wherein as reference numerals designate identical or corresponding parts throughout the several views thereof and in particular to FIGS. 1 to 4, an exemplary image forming apparatus which has a sheet conveying device according to one embodiment of the present disclosure is described. Specifically, the overall configuration of an exemplary image forming apparatus is illustrated in FIG. 1. A mechanism is included in the image forming apparatus as shown in FIG. 2. A sheet conveying device is disposed in the image forming apparatus as shown in FIG. 3. The mechanism causes a driven roller to engage and disengage with a driving roller when a sheet is linearly ejected from the image forming apparatus as shown in FIG. 4.

The image forming apparatus includes an image forming unit 2 acting as an image forming device to form an image by ejecting a droplet onto a sheet 100 acting as a printing medium. The image forming apparatus also includes a sheet conveying unit 3 acting as a sheet conveying device to convey the sheet 100 inside an apparatus body 10. The image forming apparatus also includes a processing liquid coating unit 400 on an upstream side of the image forming unit 2 in a sheet conveying direction to coat the sheet 100 with processing liquid 401. The image forming apparatus also includes a sheet-inverting unit 4 to invert the sheet 100 bearing the image thereon. The image forming apparatus also includes a sheet-exiting tray 104 to receive the sheet 100 drained therefrom. The image forming apparatus also includes a sheet feeding unit 20 having a sheet feeding cassette 103 disposed in a lower section of the apparatus body 10 to accommodate multiple sheets 100.

Here, as shown in the FIGS. 1 and 2, the image forming unit 2 holds a carriage 23 by a guiding rod 21 and a guiding tray (not shown in drawing). The carriage 23, which is prepared by aligning multiple printing heads of respective colors in a main scanning direction, is held so that movement in the main scanning direction is possible. The carriage 23 moves and executes scanning in the main scanning direction when driven by a main scanning motor 27 via a timing belt 29 wound around driving and driving pulleys 28A and 28B.

On the carriage 23, a printing head unit 24 composed of five units of droplet discharging heads which eject droplets of respective colors of black (Bk), cyan (C), magenta (M), and yellow (Y), is mounted. Further, two Bk printing heads are used, however. With such a configuration, an image is formed by ejecting an applicable droplet from the printing head unit 24 onto a sheet while moving the carriage 23 in the main scanning direction and conveying the sheet 100 from the sheet conveying unit 3 acting as a sheet conveying device in a sheet conveying direction (i.e., a sub-scanning direction) in a manner called a shuttle type system.

Here, a line type printing head prepared by aligning multi printing heads of respective colors in the sub-scanning direction can be alternatively utilized as well. However, the present disclosure is not limited to the above-described orientations of alignment of printing heads and nozzle lines of the printing heads, and an alignment order of respective colors.

Further, also on the carriage 23, multiple printing head tanks 25 are mounted to supply liquids of multiple colors to the respective printing heads 24. Although it is not shown, prescribed multiple color liquids are respectively supplied to the multiple printing head tanks 25 from the liquid cartridges removably mounted on the apparatus body 10 from a front side thereof. Here, the image forming apparatus is enabled to supply black ink from a single liquid cartridge to the pair of printing head tanks 25.

The printing head unit 24 can employ a pressure generating device, such as a piezoelectric-type actuator, a thermal type actuator, an electrostatic type actuator, etc. However, the present disclosure is not limited to the above-described exemplary droplet discharging unit.

Further, as shown in FIG. 2, a maintenance and recovery mechanism 121 is disposed in a non-printing region located at a widthwise one side end (of the image forming apparatus) in the scanning direction of the carriage 23 to recover and maintain a condition of the nozzle of the printing head unit 24.

The maintenance and recovery mechanism 121 includes four moisture retaining caps 123 and a suction cap 122 connected to a suction device (not shown) to cap five surfaces of printing heads 24. The maintenance and recovery mechanism 121 includes a wiper 124 to wipe the multiple nozzle surfaces of the printing heads 24. The maintenance and recovery mechanism 121 includes a trial discharged ink receiver 125 to receive a droplet not contributing to printing (i.e., image formation) discharged thereon (as trial ink discharging).

Further, as shown in FIG. 2, a trial discharged ink receiver 126 is also disposed in a non-printing region at the other side (of the image forming apparatus) in the scanning direction of the carriage 23 to receive droplets discharged from the five printing heads 24 thereon not contributing to printing (i.e., image formation) (as trial ink discharging). In the trial discharged ink receiver 126, the five openings 127 are formed corresponding to the printing heads 24.

Further, as also shown in FIG. 3, a sheet conveying belt 31 acting as an endless sheet conveyor is provided in the sheet conveying unit 3 to adsorb and send the sheet 100 fed from the bottom while directing the sheet to face the image forming unit 2.

The sheet conveying belt 31 is wound around a conveying roller 32 acting as a driving roller, another conveying roller 33 that keeps an image formation region flat in cooperation with the conveying roller 32, a separating roller 34 arranged downstream of the conveying roller 33 in the sheet conveying direction, and a tension roller 35. A guide member 40 is also disposed facing the image forming unit 2 to guide the sheet conveying belt 31 in an opposed region of the image forming unit 2.

The sheet conveying belt 31 is preferably a two-tiered structure. For example, the sheet conveying belt 31 includes a front surface acting as a sheet adsorption surface made of pure resin such as ETFE (Ethylene tetrafluoroethylene Ethylene tetrafluoroethylene) pure materials, etc., not subjected to resistance control, and a back side layer (e.g. a medium resistance layer, a grounded layer) made of the same material with that of the front surface and is subjected to the resistance control with carbon. However, the present disclosure is not limited to the above-described configuration, and alternatively, the sheet conveying belt 31 can be constituted as a single layer or as a multilayer structure having three or more layers.

Further, the separating roller 34 is provided to separate the sheet 100 with the image adhering to the sheet conveying belt 31 using a curvature separation principle. As shown in FIG. 3, the separating roller 34 is rotatably held by a shaft 36*b* provided at a tip of a movably rotatable link 36 movable around a rotating center of the conveying roller 33 acting as a supporting point 36*a* in a direction as indicated by an arrow. The separating roller 34 is also enabled to swing between two corresponding positions in multiple conveying paths as shown by solid and broken lines, respectively. Specifically, the separating roller 34 is positioned to be able to convey the sheet 100 in each of the sheet conveying paths.

Here, by moving the separating roller 34 to a position as shown by the broken line in the drawing, the separating roller 34 switches its position to enter the straight sheet ejecting path 306, in which the sheet 100 bearing the image thereon is linearly conveyed and sent toward the sheet-exiting tray 104.

By contrast, by moving the separating roller 34 to a position as shown by the solid line in the drawing, the separating roller 34 switches its position to enter a sheet inverting path 311, in which the sheet 100 bearing the image is sent to a sheet-inverting unit 4.

Here, a sheet conveyance distance between a position in which the sheet 100 is separated from the sheet conveying belt 31, and that, in which the image forming unit 2 is disposed, in the straight sheet ejecting path 306 is desirably substantially the same to that in the sheet inverting path 311. Specifically, with such an arrangement, a drying degree of the sheet 100 can be the same regardless of a type of the sheet conveying path, in which the sheet 100 is conveyed (i.e., the straight sheet ejecting path 306 or the sheet inverting path 311), so that the same quality of the image can be obtained regardless of a type of the sheet conveying path.

In such a situation, since the separating roller 34 is rotatable around the rotational center of the conveying roller 33 acting as a fulcrum as described above, a sheet conveying distance between a position in which the separating roller 34 separates the sheet 100 from the sheet conveying belt 31 and a position in which the image forming unit 2 is disposed can be readily substantially equalized both in the straight sheet ejecting path 306 and the sheet inverting path 311.

Here, the separating roller 34 is positioned at a prescribed place (at a given minimum distance from the conveying roller 33) enabling the sheet conveying belt 31 to always contact the conveying roller 33 with a prescribed tension. Hence, even when the sheet conveying path is switched to the other, a posture of the sheet conveying belt 31 does not change at an image forming region, so that an image can be steadily formed.

Further, when it is located at a position as shown by the broken line in the drawing, the separating roller 34 as a whole is positioned below a conveying surface formed by the pair of conveying rollers 32 and 33 that holds the sheet conveying belt 31 facing the image forming unit 2. Specifically, the separating roller 34 is placed lower than the conveying surface by a distance c as shown in FIG. 3. With this, the sheet conveying belt 31 can absolutely contact the conveying roller 33 while ensuring its flatness.

Further, as shown in FIG. 3, a tension roller 35 is held by an arm 37 that is swingable between positions as shown by solid and broken lines in a direction as indicated by an arrow in the drawing. Specifically, the arm 37 is swingable around a rotation fulcrum 37*a* acting as a fulcrum and rotatably holds the tension roller 35 around a holding fulcrum 37*b*. The arm 37 is pressed by a pressing device (not shown) in a direction in which the tension roller 35 presses the sheet conveying belt 31 in a prescribed direction.

Hence, the tension roller 35 moves following the sheet conveying belt 31 even when the sheet conveying belt 31 displaces due to swinging of the separating roller 34, and accordingly, provides a tension to the sheet conveying belt 31.

By contrast, on the upstream side of the image forming unit 2, a pressing member (e.g., a pressing roller) 38 is provided opposite the conveying roller 32 to press the sheet 100 against the sheet conveying belt 31 at an opposed position.

To adsorb the sheet 100 to the sheet conveying belt 31, a high power voltage (i.e., a power supply voltage), such as a DC voltage, a voltage prepared by superimposing a DC (Direct current) and an AC (Alternating current), etc., is supplied from a high voltage power supply 218 (i.e., a DC bias supply unit or a DC and AC superposed bias supply unit and the like) to the pressing roller 38.

Further, on the downstream side of the pressing roller 38, a pair of surface potential sensors 61*a* and 61*b* is disposed to act as surface potential detectors each to detect a surface potential on the sheet 100 at different positions in the sheet conveying direction. Specifically, the surface potential sensor 61*a* serves as a first surface potential detector located on the upstream side of the image forming unit 2. By contrast, the surface potential sensor 61*b* serves as a second surface potential detector located on the downstream side of the image forming unit 2.

Further, to charge a surface of the sheet conveying belt 31, a pair of electric charging rollers 39*a* and 39*b*, which is composed of conductive materials, is provided on the upstream side of the pressing roller 38 at different positions on the sheet conveying belt 31 in a belt circulating direction (i.e., a sheet conveying direction). The electric charging roller 39*b* is located on the downstream side of the electric charging roller 39*a*. Therefore, the electric charging roller 39*a* corresponds to a first electric charging applying device and the electric charging roller 39*b* corresponds to a second electric charging applying device. Hence, to charge the sheet conveying belt 31, a high DC voltage or a high voltage prepared by superimposing the DC and the AC (i.e., a power supply voltage) is supplied from the high voltage power supply 217 (i.e., the DC bias supply unit or the DC and AC superimposed bias supply unit and the like) to this pair of electric charging rollers 39*a* and 39*b*.

Further, on the downstream side of the electric charging roller 39*b*, a surface potential sensor 51 is positioned to detect a surface potential of the sheet conveying belt 31.

Further, as shown in FIG. 3, as the conveying roller 32 is rotated by a sub-scanning motor 331 via a timing belt 332 and a timing roller 333, the sheet conveying belt 31 circulates in the sheet conveying direction (i.e., a sub-scanning direction) as shown in FIG. 2.

Further, the sheet-inverting unit 4 includes a conveying roller 136 composed of a conductive elastic member placed on the downstream side of the sheet conveying belt 31 to act as a rotary sheet conveyor. Further, a driven roller 137 driven by the conveying roller 136 is provided to engage and disengage with the conveying roller 136 in the direction as indicated by an arrow to act as a driven rotated member. Further, the sheet-inverting unit 4 includes a path switching nail 41 that switches a sheet conveying path guiding the sheet 100 between a sheet inverting and ejecting path 309 and a double-sided sheet conveying path 304.

Specifically, the sheet-inverting unit 4 inverts the sheet 100 and sends it to one of the sheet inverting and ejecting path 309 and the double-sided sheet conveying path 304.

Here, at least a surface of the conveying roller 136 is composed of a conductive elastic member, such as conductive rubber, conductive sponge or similar material, etc. As the conductive elastic member of conductive rubber, solid rubber, such as EP rubber, chloroprene rubber, polyurethane rubber, etc., and material prepared by dispersing conductive carbon or conductive ions into foam rubber can be exemplified.

In such a situation, a volume resistivity of the conductive elastic member is preferably from about $10^2$ to about $10^{12}$ (Ω-cm), and is more preferably from about $10^3$ to about $10^6$ (Ω-cm).

Further, the driven roller 137 is placed to engage and disengage with the conveying roller 136 as described above and presses the sheet 100 against the conveying roller 136 as it engages with the sheet 100.

Hence, when a prescribed sheet type such as cardboard etc., or the environment or the like which necessitates a prescribed feeding force larger than adsorption power of the sheet conveying roller 136 according to a previous analysis is detected based on an output from a sheet thickness sensor, that of a temperature and humidity sensor (not shown) or an input from a user, for example, the driven roller 137 is pressed against the conveying roller 136. With this, since conveying power increases, a problem, such as sheet jam, etc., can be likely prevented.

In the sheet inverting and ejecting path 309, into which the sheet 100 is sent from the sheet-inverting unit 4, a conveying roller 148 having at least a surface composed of a conductive elastic member is deployed to act as a rotary sheet conveyor similar to the conveying roller 136. Further, a driven roller 149 driven by the conveying roller 148 is also disposed as a driven rotated member to be able to engage and disengage with the conveying roller 148 in a direction as show by arrow in the drawing. Here, the conveying roller 148 is accordingly located on the downstream side of the sheet conveying belt 31.

To eject the sheet 100 fed out from both the sheet inverting and ejecting path 309 and the straight sheet ejecting path 306 onto the sheet-exiting tray 104, a conveying roller (i.e., a sheet exit roller) 143 at least having a surface composed of a conductive elastic member is positioned as a rotary conveyor similar to the conveying roller 136. Further, a driven roller 144 driven by the conveying roller 143 acting as a driven rotation member is also disposed to engage and disengage with the conveying roller 143. Here, the conveying roller 143 is accordingly located on the downstream side of the sheet conveying belt 31.

Further, on the downstream side of the conveying roller 143 and the upstream side of the sheet exit tray 104, an electric charge removing device (e.g., an electric charge removing brush) 146 is disposed to remove electric charge remaining on the sheet 100 drained. Specifically, the electric charge removing device 146 is provided to eject the sheet 100 onto the sheet-exiting tray 104 while removing the electric charge applied to the sheet 100 by the pressing roller 38 that acts as an electric charge applying device.

Here, as shown in FIG. 4, the driven roller 144 is held by a link 147 capable of swinging between two positions as shown by solid and broken lines in a direction as shown by the arrow. Specifically, the link 147 is swingable around the rotation fulcrum 147*a* acting as a fulcrum and rotatably holds the driven roller 144 around a holding fulcrum 147*b*. The link 147 is pivoted by a driving mechanism (not shown).

Respective mechanisms to engage and disengage the above-described driven rollers 137 and 149 with applicable driving rollers are similarly configured as in the above-described mechanism as well.

Further, in the double-sided sheet conveying path 304, various conveying rollers, such as a conveying roller 138*a*, a driven roller 138*b*, a conveying roller 139*a*, a driven roller 139*b*, a conveying roller 140*a*, a driven roller 140*b*, etc., are disposed.

Specifically, these conveying rollers 138*a*, 139*a*, and 140*a* each serves as a rotary conveyor at least having a surface composed of conductive-conductive elastic member similar to the conveying roller 136. Here, these conveying rollers 138*a*, 139*a*, and 140*a* are accordingly located on the downstream side of the sheet conveying belt 31. Further, an engaging and disengaging mechanism that engages and disengages each of the driven rollers 138*b*, 139*b*, and 140*b* with these conveying rollers 138*a*, 139*a*, and 140*a*, respectively, includes the same mechanism as the above-described mechanism that engages and disengages with the driven roller 144.

Here, the duplex sheet conveying path 304 is used to refeed the sheet 100 sent thereto toward the pair of registration rollers 134.

The sheet feeding unit 20 is attachably detachable to and from the apparatus body 10 at a front side thereof. The sheet feeding unit 20 includes a sheet feeding cassette 103 to stack and accommodate multiple sheets 100, and a pickup roller to separate and feed the multiple sheets 100 stored in the sheet feeding cassette 103 one by one. The sheet feeding unit 20 also includes a pair of conveying rollers 132.

The sheet feeding unit 20 includes a straight manual sheet feeding tray 105 to be manually used, a pickup roller 141 to pick up and feed the sheet 100 one at a time from the straight manual sheet feeding tray 105, and a pair of conveying rollers 142.

Further, the processing liquid application system 400 includes a deformable bag-shaped processing liquid container, e.g., made of a PET (Poly Ethylene Terephthalate) film (not shown) to contain processing liquid 401 therein and a pump (also not shown) to feed the processing liquid 401 with pressure, when it is supplied from the processing liquid containers. The processing liquid application system 400 also includes a coating unit 410 to coat the sheet 100 acting as a printing medium with the processing liquid 401 or the like. Specifically, the pump pumps up the processing liquid 401 stored in the processing liquid containers, and supplies it to a liquid chamber 402 provided in a coating unit 410 via a supply path (not shown) to prepare for coating of the processing liquid 401.

Here, a liquid level detector (not shown) installed in the liquid chamber 402 detects and confirms that a height of the liquid level and an angle of the liquid plane of the processing liquid 401 supplied to the liquid chamber 402 are within given levels, respectively. Here, the liquid level detector may be an electrode pin system, for example. The electrode pin system is known and is not described in detail here, but detects the liquid level by supplying electricity to electrode pins through the liquid and checking an electrical conductive level between the electrode pins. In this way, a lack of or excessive supplying of the processing liquid 401 more than a prescribed amount to the liquid chamber 402 can be checked and reduced.

The coating unit 410 includes a conveying roller 434 that conveys the sheet 100, a coating roller 432 opposed to the conveying roller 434 to coat the sheet 100 with the processing liquid 401, and a squeeze roller 433 to supply the processing liquid 401 to the coating roller 432 while thinning it as a liquid film thereof.

Here, the coating roller 432 is placed contacting the conveying roller 434. By contrast, the squeeze roller 433 is placed contacting the coating roller 432. Accordingly, a liquid film layer of the processing liquid 401 is formed on the coating roller 432 when it is supplied by the squeeze roller 433 and the coating roller 432, and is conveyed and applied to the sheet 100 as the coating roller 432 rotates in a prescribed direction.

It is to be noted that the processing liquid 401 serves as quality modification material to modify the quality of the surface of the sheet 100 when applied to the surface of the sheet 100. For example, the processing liquid 401 serves as a fixative (e.g., a setting agent) when uniformly coated onto the sheet 100 in advance, because water in the ink is urged to quickly penetrate into the sheet 100 and a color component of ink is thickened while hastening the ink to dry to avoid blurring (e.g., feathering, bleeding, etc.) and striking through of the ink to a rear surface of the sheet, so that the productivity (i.e., a number of images outputted per unit of time) can be enhanced.

Here, as a chemical composition of the processing liquid 401, solution prepared by adding both cellulose (hydroxypropyl cellulose, etc.,) that promotes penetration of moisture and a base agent such as talc fine powder, etc., to surfactants (e.g., anion, cationic, nonionic, and mixture of two or more of these, etc.,) is exemplified. The chemical composition can further contain fine particles.

Further, the sheets 100 housed in the sheet feeding cassette 103 are separated and fed one at a time by the pickup roller 131 and is sent by the pair of conveying rollers 133 to the pair of registration rollers 134. Subsequently, the sheet 100 is sent from the pair of registration rollers 134 at a predetermined time toward the processing liquid coating unit 400 along a sheet conveying path 300. The processing liquid 401 is then coated onto the sheet 100 by the process fluid coating unit 400.

Now, an attraction principle of the conveying roller attracting a sheet thereto as a rotary conveyor in the image forming apparatus is described with reference to FIG. 5 and applicable drawings. Here, only the conveying roller 143 is mainly described. However, the other conveying rollers 136, 148, and 138*a* to 140*a* each has substantially the same configuration and executes substantially the same operation as well.

Since the DC voltage (or an AC voltage superimposed DC voltage) is supplied to the pressing roller 38 as described above, a negative (−) electric charge 700, for example, is applied onto the surface of the sheet 100 (e.g., an image forming surface) sandwiched between the sheet conveying belt 31 and the pressing roller 38.

Since a positive (+) electric charge 701 appears on the sheet conveying belt 31 due to electrostatic induction when the negative charge 700 is applied onto the sheet 100, the sheet 100 may be adsorbed by the sheet conveying belt 31 thereonto by Coulomb force.

At this moment, an attraction force may be further enhanced by previously applying a positive electric charge onto the sheet conveying belt 31 using electric charging rollers 39*a* and 39*b*.

Hence, an image is formed on the sheet 100 by the image forming unit while adsorbing and intermittently conveying the sheet 100 in this way as the sheet conveying belt 31 circulates.

Figure 5:
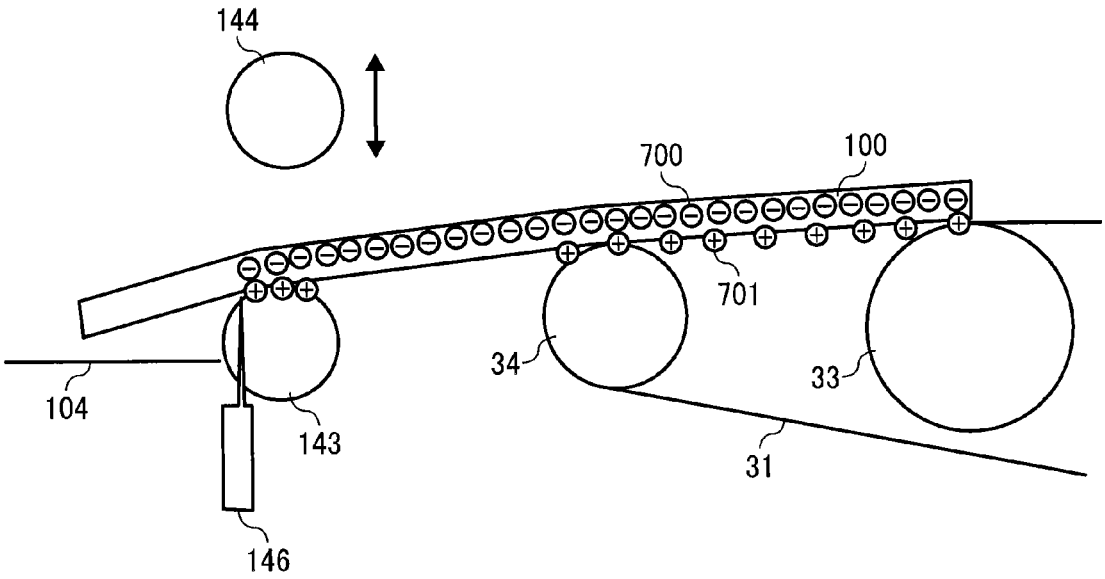
FIG. 5 is a diagram illustrating an attraction principle of a conveying roller that adsorbs a sheet as a rotary conveying device provided in the image forming apparatus of FIG. 1 according to one embodiment of the present disclosure.

Subsequently, as shown in FIG. 5, the sheet 100 with the image thereon is separated due to curvature of the separating roller 34 from the sheet conveying belt 31.

Further, the sheet 100 separated from the sheet conveying belt 31 is conveyed toward the conveying roller 143 composed of electrically conductive elastic member. Since a vertex of the conveying roller 143 is lower than a sheet conveying surface formed by the sheet conveying belt 31, the sheet 100 is hardly peeled off from both the conveying roller 143 and the sheet conveying belt 31, even after the sheet 100 is adsorbed onto the conveying roller 143.

At this moment, however, because the negative electric charge 700 has been applied onto the sheet 100, a positive electric charge 701 is electrostatically generated on the surface of the conveying roller 143 composed of an electrically conductive elastic member.

With this, since the negative electric charge 700 in the sheet 100 and the positive electric charge 701 in the conveying roller 143 attract each other, the sheet 100 is adsorbed onto the conveying roller 143 by the Coulomb force.

Here, since a contact area between the conveying roller 143 and the sheet 100 is apparently smaller than that between the sheet conveying belt 31 and the sheet 100, a stronger sheet absorption force is needed to constantly convey the sheet 100 than when it is conveyed by the sheet conveying belt 31. In this regards, it is necessary to raise the electric attraction force of the conveying roller 143 having a different construction from the sheet conveying belt 31. The sheet conveying belt 31 is a two-tier structure composed of an insulating layer on its surface and a resistance controlled (conductive) layer with its resistance controlled by carbon on its backside. On the other hand, the surface of the conveying roller 143 is composed of a conductive member.

The sheet 100 adsorbed onto the conveying roller 143 is then sent and ejected onto the sheet-exiting tray 104 by the conveying roller 143.

Here, since a charge removing device 146 is disposed between the conveying roller 143 and the sheet-exiting tray 104 to remove the negative electric charge 700 remaining on the sheet 100, the sheet 100 can exit onto the sheet-exiting tray 104 without bearing the negative electric charge 700 thereon. Hence, multiple sheets 100 exiting onto the sheet-exiting tray 104 can probably avoid sticking to each other due generally to the electrostatic charge remaining thereon.

Heretofore, in this embodiment, the conductive elastic member is employed as the exemplary rotary conveyor, because it has a relatively high friction coefficient and accordingly a large adsorption force and is prepared at a low cost. However, the present disclosure is not limited thereto, and the similar conveying force can be also obtained by utilizing a belt or a roller at least having a surface composed of a conductive member as well.

Now, with reference to FIG. 1, an aspect when the sheet 100 bearing the image formed in the image forming unit 2 is linearly ejected onto the sheet-exiting tray 104 is described.

As described earlier, the sheet 100 coated with the processing liquid 401 is conveyed into the sheet conveying path 305 via the pair of conveying rollers 145. Subsequently, in the sheet conveying path 305, the sheet 100 is fed onto the sheet conveying belt 31, in which a DC electric field is formed. The sheet 100 is then given an electric charge having a reverse polarity to that of the sheet conveying belt 31 by the pressing roller 38. Consequently, the sheet 100 is electrostatically adsorbed onto the sheet conveying belt 31 and is held thereon.

Then, the printing head unit 24 is driven based on an image signal while moving the carriage 23 with respect to the sheet 100 and executes printing on the sheet 100 by ejecting droplets thereon to form an image of one line when the sheet 100 reaches and stops at a starting position for starting image formation. When one line printing is completed, the sheet 100 is sent by an amount of one line to execute printing on the next line. Thus, by intermittently conveying the sheet 100, an image is sequentially formed on the sheet 100 (line by line). When receiving either a signal indicating that printing is completed or indicating that the end of sheet 100 reaches the end of a printing region, the printing is terminated.

Here, the separating roller 34 is moved to a position as shown by the broken line in FIG. 1 (i.e., a position as shown by the solid line in FIG. 4), at latest, before the tip of the sheet 100 in the process of image formation reaches the conveying roller 33.

By this, the sheet 100 bearing the image is conveyed and is adsorbed and further conveyed by the conveying roller 143 along the straight sheet ejecting path 306 as the sheet conveying belt 31 moves and circulates. The sheet 100 bearing the image finally exits onto the sheet-exiting tray 104 with the printing surface facing upward. Further, also in this situation, as described earlier, since the electric charge is applied onto the sheet 100, an electric charge having a reverse polarity to that of the sheet 100 is excited (generated) on the conveying roller 143, and the sheet 100 is electrostatically adsorbed thereon and is further conveyed by the conveying roller 143.

Now, an exemplary operation executed when the sheet 100 bearing the image formed in the image forming unit 2 is inverted and is ejected onto the sheet-exiting tray 104 in the image forming apparatus is described.

Specifically, similar to the situation in which the sheet 100 is linearly ejected, the printing head unit 24 is driven based on an image signal while moving the carriage 23 with respect to the sheet 100 and executes printing on the sheet 100 by ejecting droplets thereon to form an image of one line when the sheet 100 reaches and stops at a starting position for starting image formation. When the one line is printed, the sheet 100 is sent by an amount of one line to execute printing on the next line. Thus, by intermittently conveying the sheet 100, an image is sequentially formed on the sheet 100 (line by line). When receiving either a signal indicating that the printing is completed or indicating that the end of sheet 100 reaches the end of a printing region, the printing is terminated.

Here, the separating roller 34 is moved to a position as shown by the solid line in FIG. 1, at latest, before the tip of the sheet 100 in the process of image formation reaches the conveying roller 33.

By this, the sheet 100 bearing the image formed in this way is subsequently conveyed and diagonally sent downward and is further sent into the sheet-inverting unit 4 through the sheet inverting path 311 by the sheet conveying belt 31 as it circulates.

Since an electric charge has been given to the sheet 100, an electric charge having a reverse polarity to that of the sheet 100 is excited (i.e., generated) in the conveying roller 136 as described earlier, and the sheet 100 is electrostatically adsorbed and conveyed by the conveying roller 136 and is taken in by the sheet-inverting unit 4.

Further, the sheet 100 conveyed into the sheet-inverting unit 4 subsequently evacuates from the sheet-inverting unit 4 as the conveying roller 136 reversely rotates. At this moment, a path switching nail 41 is located at a position as shown by a solid line in the drawing, and accordingly, the sheet 100 fed out by the conveying roller 136 is conveyed toward the sheet inverting and ejecting path 309.

In the sheet inverting and ejecting path 309, since the electric charge has been given to the sheet 100, an electric charge having a reverse polarity to that of the sheet 100 is excited in the conveying roller 148 as described earlier, the back side of the sheet 100 opposite a front side bearing the image formed in this way is electrostatically adsorbed by the conveying roller 148 and is thereby conveyed downstream.

The sheet 100 is subsequently sent to the conveying roller 143 from the sheet inverting and ejecting path 309. Subsequently, since the electric charge is given to the sheet 100, and an electric charge having a reverse polarity to that of the sheet 100 is excited in the conveying roller 143 as described earlier, the sheet 100 is electrostatically adsorbed and conveyed by the conveying roller 143. The sheet 100 consequently exits onto the sheet-exiting tray 104 with its printing surface facing down.

Here, since the conveying roller 143 is also used in executing the straight sheet ejection, the conveying roller 143 adsorbs the image printed surface of the sheet 100 when the sheet inverting and ejecting process is executed. However, since the sheet 100 passes through the sheet-inverting unit 4 in the sheet inverting and ejecting process, an ink drying and settling time can be relatively sufficiently ensured before the sheet 100 reaches the conveying roller 143, and accordingly, the ink almost never adheres to the conveying roller 143.

Here, by supposing that the sheet 100 having a property of poor ink drying fixative is conveyed, the driven roller 144 disposed opposed to the conveying roller 143 can also be composed of a conductive elastic member as well so that the sheet 100 can be adsorbed onto the driven roller 144 and conveyed in the sheet inverting and ejecting process.

Here, all of the conveying rollers placed downstream of the sheet conveying belt 31 while facing the back side of the sheet 100 are not necessarily conductive to adsorb the sheet 100, and only some of the conveying rollers need be conductive to adsorb the sheet 100 as well. In particular, a prescribed conveying roller disposed closer to the sheet conveying belt 31 is preferably enabled to adsorb the sheet 100.

Now, an operation of forming multiple images on both sides of the sheet 100 respectively is described.

As described above, the sheet 100 coated with the processing liquid 401 is conveyed to sheet conveying path 305 via the pair of rollers 145. In the sheet conveying path 305, the sheet 100 is fed onto the sheet conveying belt 31, in which a DC electric field is formed. The sheet 100 is subsequently given an electric charge having a reverse polarity to that of the sheet conveying belt 31 by the pressing roller 38. Accordingly, the sheet 100 can be electrostatically adsorbed onto the sheet conveying belt 31 and is held thereon.

Then, the printing head unit 24 is driven based on an image signal while moving the carriage 23 with respect to the sheet 100 and executes printing on the sheet 100 by ejecting droplets thereon to form an image of one line when the sheet 100 reaches and stops at a starting position for starting image formation. Hence, by intermittently conveying the sheet 100, an image is sequentially formed on the sheet 100 (line by line). When the one line is printed, the sheet 100 is sent by one line to execute printing on the next line. When receiving either a signal indicating that the printing is completed or indicating that the end of sheet 100 reaches the end of a printing region, the printing is terminated.

Here, the separating roller 34 is moved to a position as shown by the solid line in FIG. 1, at latest, before the tip of the sheet 100 in the process of image formation reaches the conveying roller 33.

By this, the sheet 100 bearing the image formed in this way is subsequently conveyed and diagonally sent downwardly and is further sent into the sheet-inverting unit 4 through the sheet inverting path 311 by the sheet conveying belt 31 as it circulates.

Since the electric charge has been given to the sheet 100, and an electric charge having a reverse polarity to that of the sheet 100 is excited in the conveying roller 136 as described earlier, the sheet 100 is electrostatically adsorbed and is conveyed by the conveying roller 136. The sheet 100 is subsequently taken in by the sheet-inverting unit 4.

Further, the sheet 100 conveyed into the sheet-inverting unit 4 subsequently evacuates from the sheet-inverting unit 4 as the conveying roller 136 reversely rotates. At this moment, a path switching nail 41 is located at a position as shown by a broken line in the drawing, and accordingly, the sheet 100 sent by the conveying roller 136 is conveyed toward the double-sided sheet conveying path 304. The sheet 100 is subsequently conveyed by multiple conveying rollers 138*a*, 139*a*, and 140*a* and is sent to the pair of registration rollers 134 again.

Here, as described earlier, since the electric charge has been applied onto the sheet 100 again, and a reverse polarity to that in the sheet 100 is excited (i.e., generated) on the multiple conveying rollers 138*a* to 140*a*, the sheet 100 is electrostatically adsorbed thereon and is further conveyed by these multiple conveying rollers 138*a* to 140*a*.

Subsequently, the sheet 100 sent to the pair of registration rollers 134 is resent therefrom at a predetermined time toward the processing liquid coating unit 400 via the sheet conveying path 300.

The processing liquid 401 is subsequently coated onto the other side (in which the image has not formed yet) of sheet 100 by the process fluid coating unit 400 as described above. Subsequently, after an image is formed on the other side of the sheet in the image forming unit 2, the sheet 100 is further conveyed as the sheet conveying belt 31 shown by a broken line circulates and exits onto the sheet-exiting tray 104 along the straight sheet ejecting path 306, with its printing side facing upward as the conveying roller 143 rotates.

Now, an operation of a straight sheet ejection process in which the sheet 100 is almost linearly fed and conveyed from the manual sheet feeding tray 105 is described.

Specifically, by using the manual sheet feeding tray 105, an image can be easily formed on a special sheet, such as a cardboard, a sticker release paper sheet, etc., as well. Further, since a path extended from the manual sheet feeding tray 105 joins the sheet conveying path downstream of the processing liquid coating unit 400 in the conveying direction, a sheet such as a coated sheet, etc., not requiring coating of the processing liquid is preferably fed from the manual sheet feeding tray 105 as well. For this reason, the manual sheet feeding tray 105 is enabled to load several sheets thereon while enabling the pickup roller 141 to pick up and supply the sheets 100 one at a time.

Specifically, the sheets 100 housed in the manual sheet feeding tray 105 are separated and fed one at a time by the pickup roller 141, and conveyed by the conveying roller 142 toward the printing sheet conveying path 305. Subsequently, as described above, the sheet 100 is intermittently conveyed by the sheet conveying belt 31 again, and an image is formed thereon in the image forming unit 2.

Subsequently, the sheet 100 bearing the image is further conveyed as the sheet conveying belt 31 shown by a broken line circulates and exits onto the sheet-exiting tray 104 through the straight sheet ejecting path 306, with its printing side facing upward as the conveying roller 143 rotates.

Heretofore, conveying operation of the multiple driven rollers 137, 149, 144, and 138*b* to 140*b* is not described. However, as described earlier, in accordance with a sheet type and environmental conditions (such as temperature, humidity, etc.) or the like, the driven rollers 137, 149, 144, and 138*b* to 140*b* are moved to contact the respective conveying rollers 136, 148, 144, and 138*a* to 140*a* to press the sheet 100 thereagainst.

Figure 6:
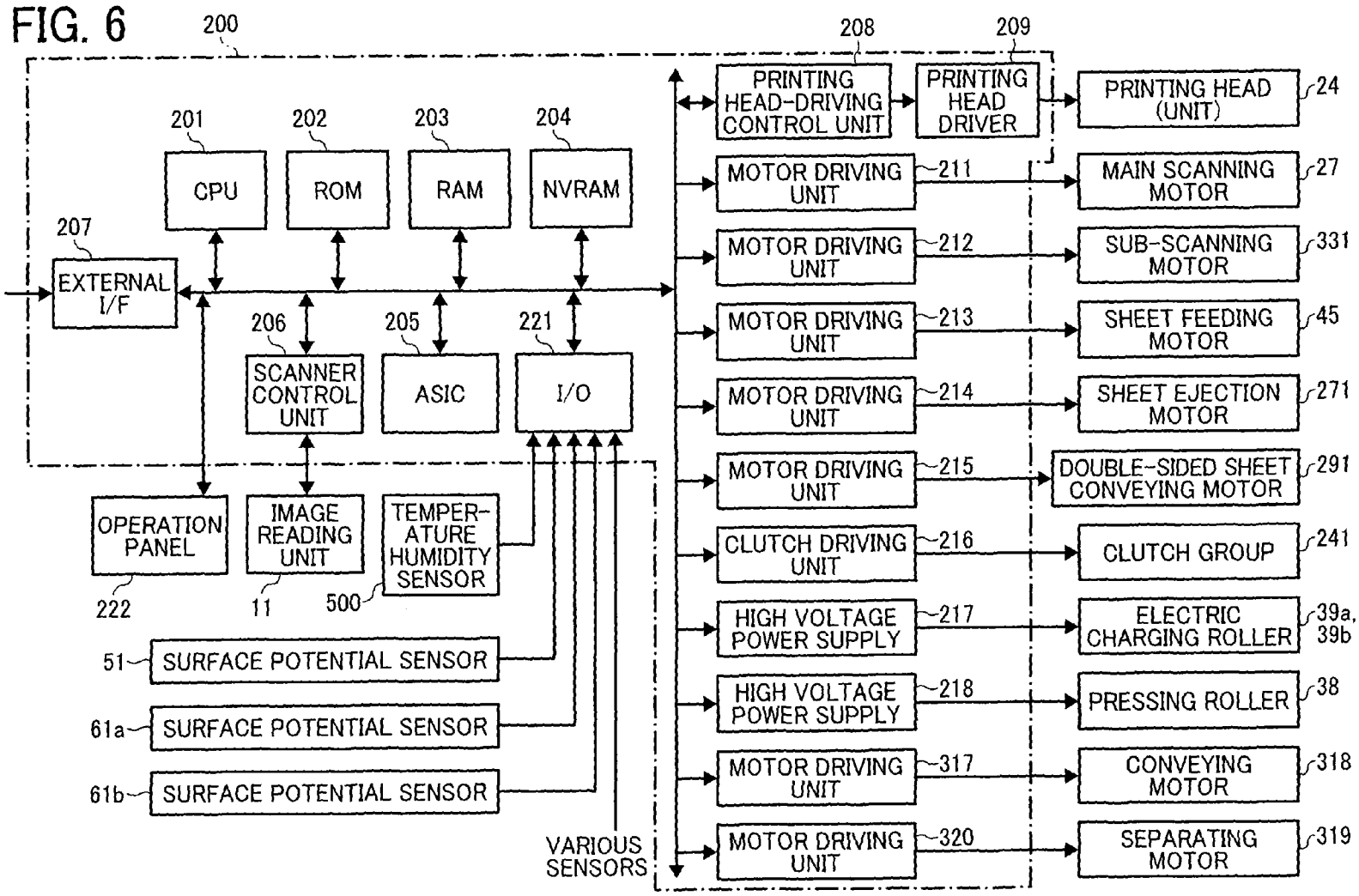
FIG. 6 is a block diagram of a control unit provided in the image forming apparatus of FIG. 1 according to one embodiment of the present disclosure.

Now, an overview of a control unit provided in the image forming apparatus is described with reference to FIG. 6.

Specifically, the control unit 200 is comprised of a CPU (central processing unit) 201 that generally controls the image forming apparatus, a ROM (read only memory) 202 that stores programs and the other fixed data implemented by the CPU 201, and a RAM (random access memory) 203 that temporarily stores image data (i.e., printing data), etc.

The control unit 200 also includes a non-volatile memory (NVRAM) 204 that holds data even when a power supply is interrupted. The control unit 200 also includes an ASIC (application specific integrated circuit) 205 that applies various signal processes to image data, executes image forming processes such as sorting, etc., and handles input and output signals other than those of processes to generally control the image forming apparatus.

Further, the control unit 200 also includes a scanner control unit 206 that controls an image reading unit 11 to read an image and processes image data read by the image reading unit 11 and so forth.

The control unit 200 also includes an external I/F (Interface) 207 used to receive data from an external device and is enabled to send and receive data and signals. The control unit 200 also includes a printing head-driving control unit 208 and a printing head driver 209 collectively controlling the printing head unit 24 included in the image forming unit 2 to operate.

Further, included in the control unit 200 are a motor driving unit 211 that drives a main scanning motor 27 to execute main scanning of the carriage 23, and a motor-driving unit 212 that drives the sub-scanning motor 331 to rotate the conveying roller 32 and accordingly circulate the sheet conveying belt 31.

Further, included in the control unit 200 are a motor driving unit 213 that drives a sheet feeding motor 45, and a motor driving unit 214 that drives a sheet ejection motor 271 to operate and rotate various rollers, such as the sheet conveying roller 143, etc.

Further, included in the control unit 200 are a motor driving unit 215 that drives a double-sided sheet conveying motor 291 to drive and rotate various rollers located in a duplex sheet conveying path 304, and a motor-driving unit 317 that drives a conveying motor 318 to drive and rotate the conveying roller 136 located in the sheet-inverting unit 4.

The control unit 200 also includes a motor driving unit 320 that drives a separating motor 319 to move the separating roller 34.

The control unit 200 further includes a clutch driving unit 216 that drives a clutch group 241. The clutch group 241 includes multiple sheet feeding-electromagnetic clutches that independently drive and rotate the pickup roller 131 and the pair of conveying rollers 132, and the pickup roller 141 and the pair of conveying rollers 142, respectively. Further, the clutch group 241 includes an electromagnetic clutch that independently drives the sheet conveying paths and a path switching plate solenoid that pivots the path switching nail 41 to switch the sheet conveying path to the other.

The control unit 200 further includes the high voltage power supply 217 that supplies a high voltage to the pair of electric charging rollers 39*a* and 39*b*. The high voltage power supply 217 can independently control each of the high voltages applied to the pair of electric charging rollers 39*a* and 39*b*, respectively.

The control unit 200 further includes a high voltage power supply 218 that supplies a high voltage to the pressing roller 38.

The control unit 200 also includes an I/O (Input and Output port) 221 that captures detection signals from various sensors. Specifically, a detection signal is inputted to the I/O 221 from the temperature humidity sensor 500 that detects temperature and humidity as an environmental condition. Also inputted to the I/O 221 are detection signals from an image formation starting sensor (not shown) and an image formation end sensor (not shown). Further, measuring signals from the respective surface potential sensors 51, 61*a*, and 61*b* are inputted to the I/O 221.

Further, an operation panel 222 is connected to the control unit 200 to input and display information necessary for the apparatus.

Accordingly, the control unit 200 processes and stores read image data in a buffer included in the scanner control unit 206 when the image reading unit 11 reads an image of an original document. By contrast, the control unit 200 stores printing data or the like in a buffer included in an external I/F 207 upon receiving it from an external host, such as an information processing device (e.g., a personal computer), an image reader (e.g., an image scanner), an imaging device (e.g., a digital camera), etc., via the external I/F 207.

Then, the CPU 201 reads image data from the scanner control unit 206 or the external I/F 207, and analyzes the image data. The ASIC 205 then executes necessary image processing and data reordering processing or the like and transfers printing image data to a printing head-driving control unit 208. Here, dot pattern data for outputting an image based on data sent from the external device can be generated by storing font data in the ROM 202, for example. Otherwise, image data can be spread as bitmap data by a printer driver provided in the external host, and is transferred to the image forming apparatus.

Upon receiving the image data (e.g., the dot pattern data) corresponding to one line of each printing head of the printing head unit 24, the printing head-driving control unit 208 transfers the one line dot pattern data to a printing head driver 209. Based on the dot pattern data, the printing head driver 209 selectively provides a driving waveform and drives an actuator included in the printing head unit 24 and lets a prescribed nozzle of the printing head of the of the printing head unit 24 discharge a droplet therefrom.

Hence, in the image forming apparatus configured in this way, the sheet 100 is fed one by one from either the sheet feeding unit 20 or the double-sided sheet conveying path 310 and is pressed against the sheet conveying belt 31 by the pressing roller 38. As a result, a conveying direction of the sheet 100 is changed by an angle of about 90°. The sheet 100 is then electrostatically adsorbed onto the sheet conveying belt 31 and is further conveyed in the sub-scanning direction as the sheet conveying belt 31 circulates.

Then, the printing head unit 24 is driven based on an image signal and executes printing an image of one line on the currently stopping sheet 100 by ejecting a droplet thereonto while moving the carriage 23. When one line printing is completed, the sheet 100 is sent by one line to execute printing on the next line. In this way, by intermittently conveying the sheet 100, an image is sequentially formed on the sheet 100 (e.g., line by line).

Upon receiving either a signal indicating that the printing is completed or indicating that the end of sheet 100 reaches the end of a printing region, the printing is terminated.

At this moment, by moving the separating roller 34 between positions in accordance with usage of the sheet conveying path as shown by solid and broken lines in the drawing as described above, the sheet conveying path for conveying the sheet 100 bearing the image is switched. The sheet 100 is accordingly sent onto the sheet-exiting tray 104 via a prescribed conveying path.

Now, charging control applied to the sheet 100 via control of power supplying to the pressing roller 38 according to one embodiment of the present disclosure is described with reference to FIG. 7.

Figure 7:
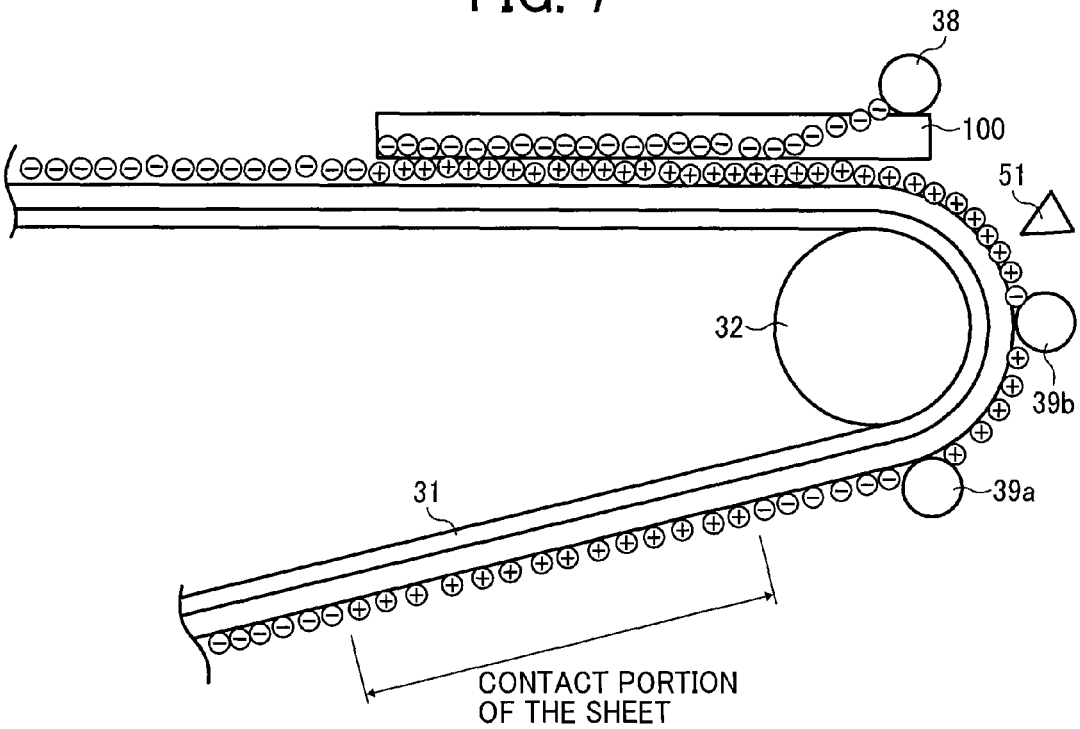
FIG. 7 is a diagram illustrating an exemplary charged state of the sheet and that of a sheet conveying belt when electric charging control is executed (by controlling power supply to a pressing roller), according to one embodiment of the present disclosure.

FIG. 7 is a diagram illustrating a charged state of each of the sheet 100 and the conveying belt 31 when charging control is implemented thereon via control of power supplying to the pressing roller 38.

Initially, as shown in FIG. 7, the high voltage power supply 217 (as shown FIG. 3) provides a high voltage to the electric charging roller 39*a*. The electric charging roller 39*a* provides positive electric charge to the sheet conveying belt 31. Thus, the sheet conveying belt 31 bears the positive electric charge thereon. Similarly, the high voltage power supply 217 supplies a high voltage to the electric charging roller 39*b*. The electric charging roller 39*b* then supplies positive electric charge to the sheet conveying belt 31 to electrically positively charge the sheet conveying belt 31 uniformly so that it bears the positive electric charge thereon.

Thus, with electric charging rollers 39*a* and 39*b*, the sheet conveying belt 31 is charged in the same polarity in two steps, and, finally is charged in the required amount of electric charges. Here, the number of electric charging rollers is not limited to two; there may be more than two.

Such a positively charged state of the sheet conveying belt 31 is detected by the surface potential sensor 51. The control unit 200 subsequently adjusts the high voltage (i.e., the power supply voltage) supplied from the high voltage power supply 217 to at least one of electric charging rollers, preferably 39*b*, based on the detection result to render the surface potential to be a given value.

By contrast, the sheet 100 is conveyed onto the sheet conveying belt 31 bearing the positive electric charge thereon. At this moment, by receiving negative electric charge, the sheet 100 is negatively electrically charged by the pressing roller 38 to which a high voltage is supplied from the high voltage power supply 218 (as shown FIG. 3).

By negatively charging the sheet 100 from above the sheet 100, since the electric charge on the sheet 100 and that on the sheet conveying belt 31 are balanced, the surface potential on the sheet 100 can be reduced. Here, the surface potential on the image formation side of the sheet 100 is controlled to less than 200V, preferably less than 100V.

As described above, in this embodiment, a plurality of electric charging rollers (two of the 39*a* and 39*b* in this example) which are arranged at different positions in the conveying direction, apply charges of the same polarity to the sheet conveying belt 31 in two or more steps.

The control unit 200 measures the surface potential on the sheet conveying belt 31 by the surface potential sensor 51 and adjusts the feeding voltage that electric charging rollers 39*a* and 39*b* are given by the high voltage power supply 217, so that the value of the surface potential measured by the surface potential sensor 51 becomes a predetermined value. Below, the effect of this embodiment is demonstrated, in comparison with an example in which only one electric charging roller (referred to as "electric charging roller 39") is used.

First, the relationship between the surface potential and environmental conditions in the comparative example is explained with reference to FIG. 8. Here, the resistance of charge roller is $10^{5.5}\Omega$ and the applied voltage value from the electric charging roller 39 to the sheet conveying belt 31 is 2000V.

Figure 8:
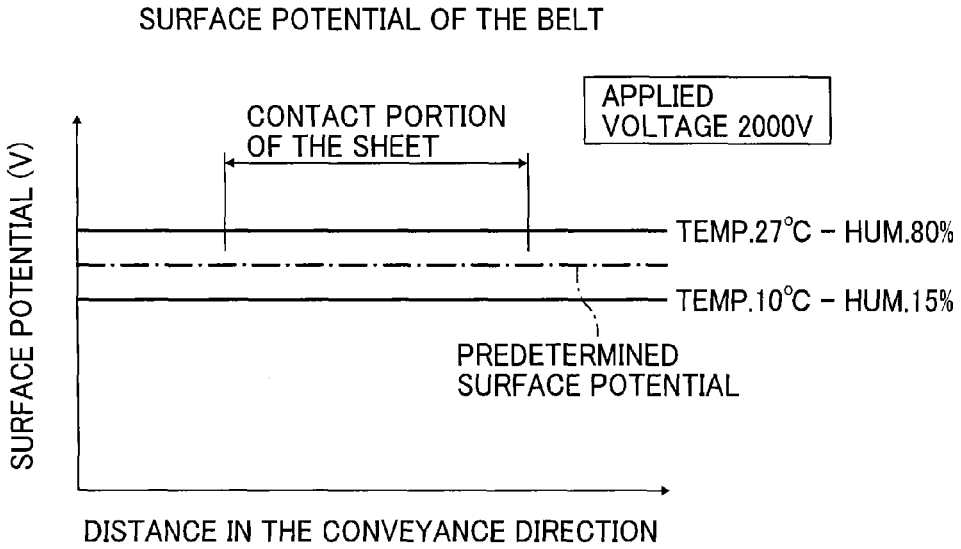
FIG. 8 is a chart illustrating the relationship between the surface potential and environmental conditions according to a comparative example in which only one electric charging roller is used.

As shown in FIG. 8, under the low-temperature and low-humidity environment (where temperature is 10° C., and humidity is 15%), the surface potential which occurs according to the charge quantity on a sheet conveying belt 31 does not reach the predetermined surface potential required for adsorption of a sheet 100. Since the conveying speed is increased with the increase of the recording speed, the voltage application time from the electric charging roller 39 is reduced, and decreasing tendency of the surface potential under the low-temperature and low-humidity environment becomes especially noticeable.

In this case, to increase the charge quantity on the sheet conveying belt, it is necessary to increase the applied voltage. However, by increasing the applied voltage, the possibility that the sheet conveying belt 31 and the electric charging roller 39 will burn or ignite by the spark discharge from the electric charging roller 39 becomes high. Therefore, there is a limit in obtaining the predetermined surface potential by increasing the applied voltage. Next, the relationship between the applied voltage from the electric charging roller 39 and the surface potential of the sheet conveying belt 31 for each different resistance of the electric charging roller 39 according to the comparative example is described with reference to FIG. 9. Here, FIG. 9 shows the case where the low-temperature and low-humidity environment (temperature 10° C., humidity 15%) and conveyance speed are 1000 mm/s in the above-mentioned example.

Figure 9:
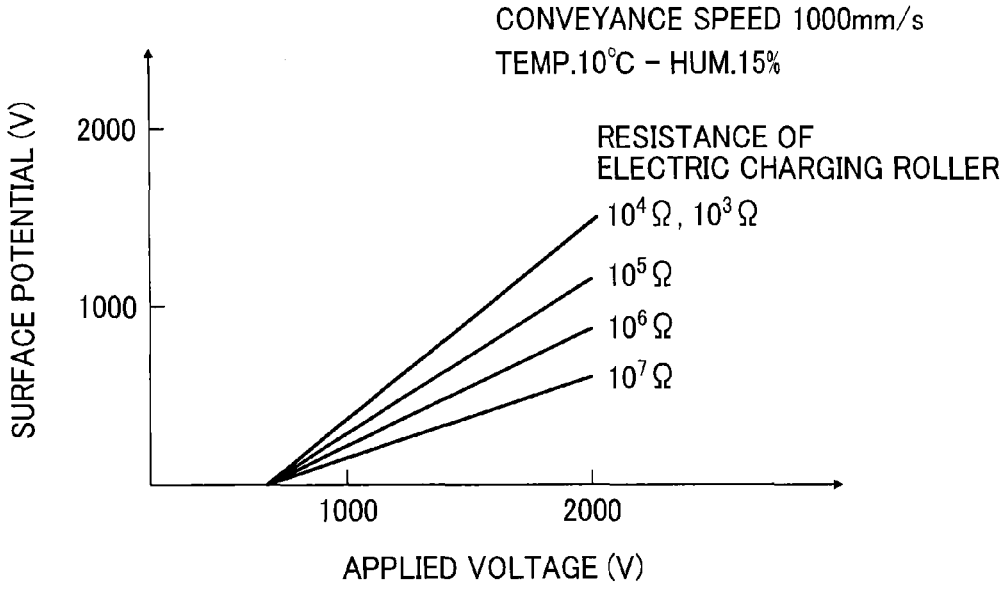
FIG. 9 is a chart illustrating the relationship between the applied voltage and the surface potential for each different resistance of the electric charging roller according to the comparative example.

As shown in FIG. 9, under the low-temperature and low-humidity environment (temperature 10° C., humidity 15%), the surface potential of the sheet conveying belt 31 increases with the fall of the resistance of the electric charging roller 39, and when the resistance decreases to $10^4\Omega$, the surface potential takes a maximum and does not rise any more. That is, the relationship between the applied voltage from the electric charging roller 39 and the surface potential of the sheet conveying belt 31 does not change when the resistance of the electric charging roller 39 is $10^4\Omega$ or less.

Therefore, even if the same applied voltage of 2000V is applied from electric charging roller 39, the surface potential of the sheet conveying belt 31 can be raised, as opposed to the case in FIG. 8, by lowering the resistance of the electric charging roller 39 to $10^4\Omega$ from $10^{5.5}\Omega$.

Figure 10:
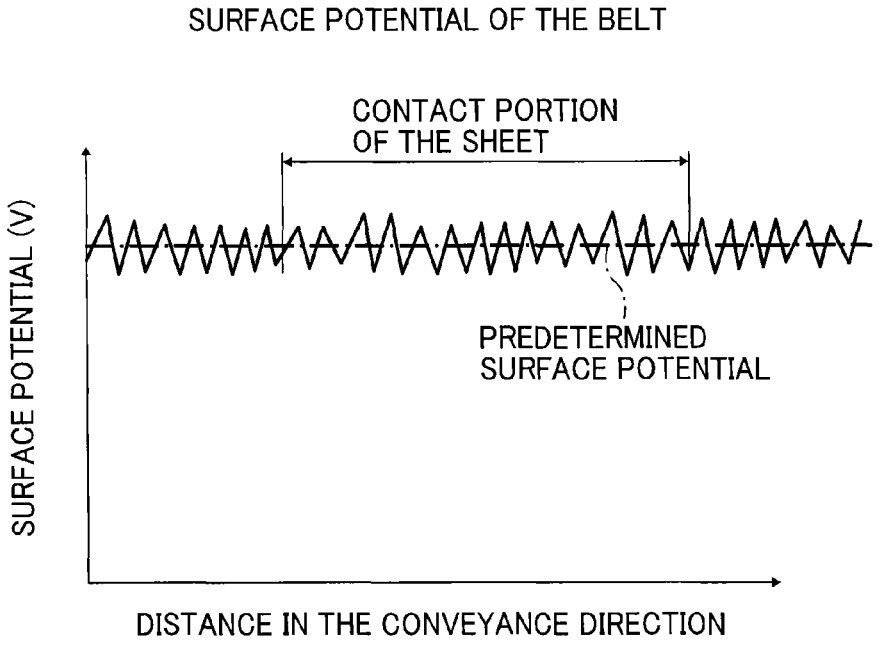
FIG. 10 is a chart illustrating the state of the surface potential that is charged by the electric charging roller of low resistance according to the comparative example.

The state of the surface potential of the sheet conveying belt 31 which set the resistance value of the electric charging roller 39 to $10^4\Omega$, and is charged with the applied voltage of 2000V is shown in FIG. 10. Here, only the state under the low-temperature and low-humidity environment (temperature 10° C., humidity 15%) is shown.

By lowering the resistance of the charging electric roller 39, the charged amount of electric charges increases and the surface potential of the sheet conveying belt 31 reaches the predetermined surface potential required for adsorption of a sheet 100. However, since the resistance of the electric charging roller 39 is lowered, the variation of the resistance in the surface of the electric charging roller 39 easily affects the surface potential of the sheet conveying belt 31, therefore the surface potential of the sheet conveying belt 31 becomes uneven. Since the surface potential of the sheet conveying belt 31 cannot be made uniform, the surface potential on the image formation side of the sheet 100 cannot be uniformly made small either.

Figure 11:
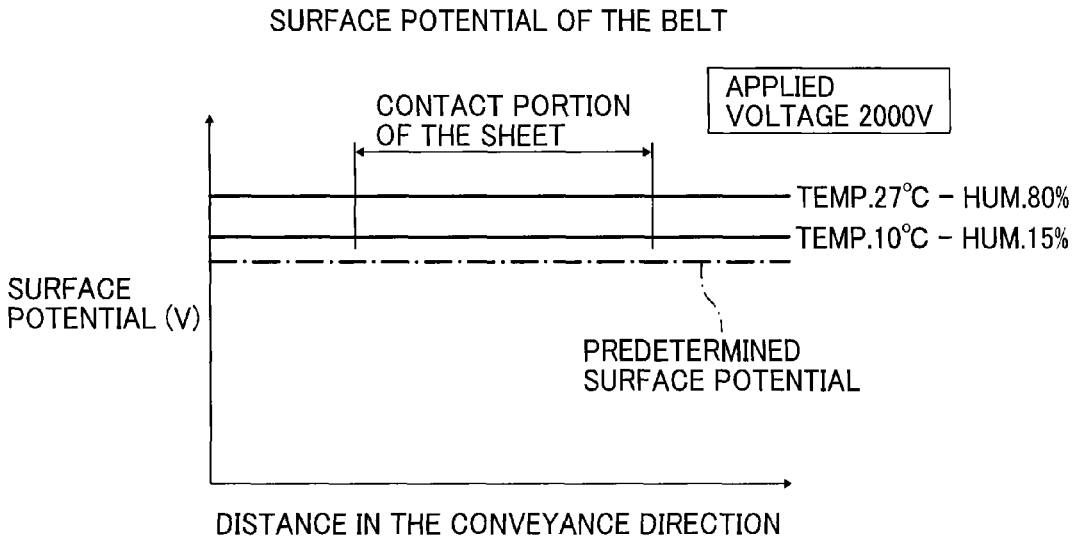
FIG. 11 is a chart illustrating the relationship between the surface potential and environmental conditions according to one embodiment of the present disclosure in which two electric charging rollers are used.

By contrast, according to one embodiment, even if it is under the low-temperature and low-humidity environment (temperature 10° C., humidity 15%), the surface potential of the sheet conveying belt 31 can be made more than the predetermined surface potential required for adsorption of a sheet 100, as shown in FIG. 11. Besides, by applying voltage to the sheet conveying belt 31 in two steps from two electric charging rollers 39*a* and 39*b* of high resistance, the applied voltage per electric charging roller is not increased and the surface potential of the sheet conveying belt 31 does not become uneven. Since the surface potential of the sheet conveying belt 31 can be made more than the predetermined surface potential, it is easy to control it to the predetermined value by decreasing the applied voltage from electric charging rollers 39*a* and 39*b*.

Here, both resistances of the two electric charging rollers 39*a* and 39*b* are $10^{5.5}\Omega$, and the applied voltage from the electric charging rollers 39*a* and 39*b* to the sheet conveying belt 31 is set to 2000V. That is, all the conditions are the same as in FIG. 8 except that there are two electric charging rollers. In addition, the change of the state of the surface potential by the electric charge quantity on the sheet conveying belt 31 when a resistance of the electric charging roller 39*a* is lower than a resistance of the electric charging roller 39*b* is shown in FIG. 12.

Figure 12A:
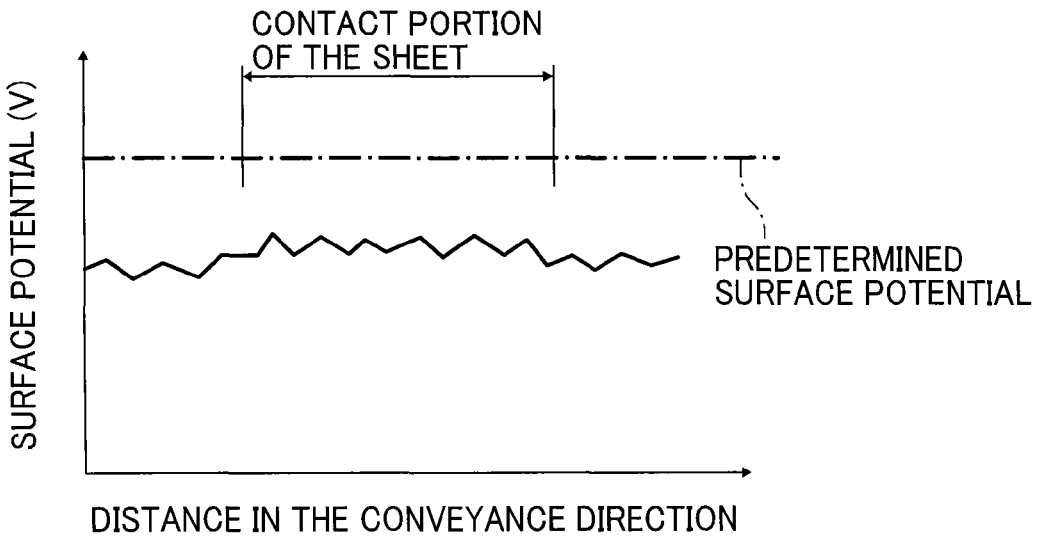
FIGS. 12A and 12B are charts illustrating the transition of the surface potential when the resistance of the electric charging roller on the upstream side is lower than the resistance of the electric charging roller on the downstream side according to one embodiment of the present disclosure.

As shown in FIG. 12A, because a resistance of the electric charging roller 39*a* is low, by applying voltage only by the electric charging roller 39*a*, the unevenness of the surface potential of the sheet conveying belt 31 becomes large. However, as shown in FIG. 12B, the unevenness of the surface potential in the sheet conveying belt 31 can be reduced by applying voltage by the electric charging roller 39*b* having higher resistance, and the surface potential can uniformly be raised to the predetermined surface potential required for adsorption of a sheet 100.

Here, because the resistance of the electric charging roller 39*a* which is arranged at the upstream side is low, even if the same applied voltage is applied from the electric charging roller 39*a*, the surface potential of the sheet conveying belt 31 can be raised, as shown in FIG. 9. As a result, because the applied voltage necessary to electrify to the sheet conveying belt 31 in the predetermined surface potential can be reduced, there is a reduction in manufacturing cost.

On the other hand, when the predetermined surface potential is a considerable high electric potential, applying voltage to the sheet conveying belt 31 is needed many times using many electric charging rollers. Since many electric charges can be charged on the sheet conveying belt 31 by making the resistance of the electric charging rollers (other than the electric charging roller 39*b* of the downstream side) low, the number of times of applying voltage (namely, the number of electric charging rollers) can be reduced.

Figure 12B:
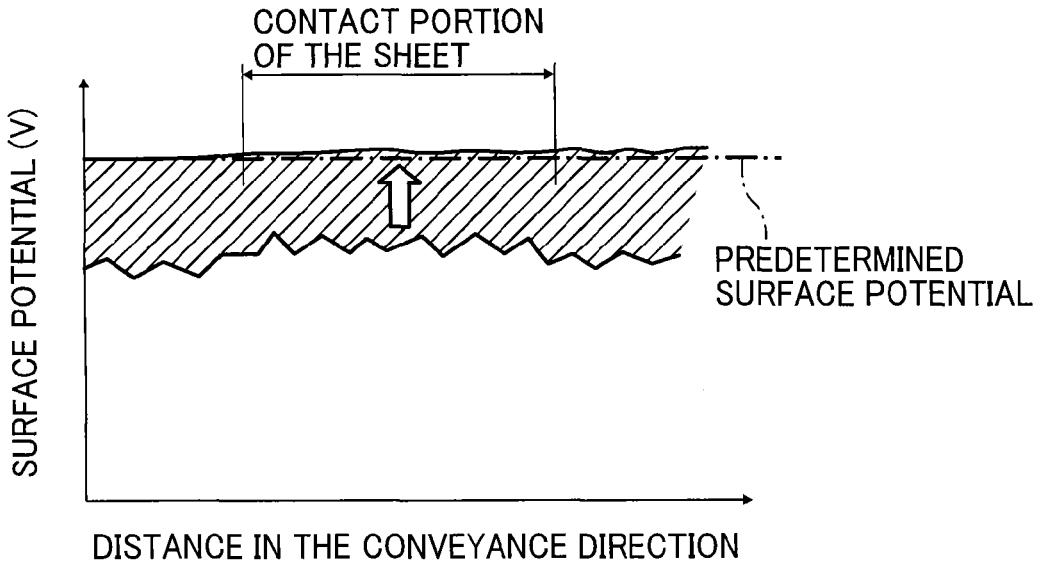

As described above, FIG. 12A shows the surface potential of the sheet conveying belt 31 to which applied voltage is applied with the electric charging roller 39*a* at the upstream side, and FIG. 12B shows the surface potential of the sheet conveying belt 31 to which further applied voltage is applied with the electric charging roller 39*b* at the downstream side. At this time, the voltage applied to the electric charging roller 39*a* is controlled to be lower than the predetermined surface potential using a resistor 330.

Because it is possible to change the surface potential from low surface potential to high surface potential as shown in FIG. 12, but it is not possible to change the surface potential from high surface potential to low surface potential, the surface potential cannot be returned to the predetermined surface potential with the electric charging roller 39*b* if applying the voltage with the electric charging roller 39*a* more than the predetermined surface potential.

Here, although a fixed resistance may be sufficient as the resistor 330, if a variable resistor is used, control that is still more precise can be performed so that the surface potential of the sheet conveying belt 31 may be brought closer to the predetermined surface potential.

Here, although the voltage applied to the electric charging roller 39*a* may be changed by changing the power supply voltage from the high voltage power supply 217, the high voltage power supply 217 must be separate for the electric charging roller 39*a* and the electric charging roller 39*b*. On the other hand, as described above, by changing the resistance between the high voltage power supply 217 and the electric charging roller 39*a*, the voltage that is applied to the electric charging roller 39*a* is controlled. Thereby, two electric charging rollers can be used with one high voltage power supply 217, so the cost of the device can be reduced.

Here, the applied voltage from electric charging rollers 39*a* and 39*b* may be applied to all the area of the conveyance direction of the sheet conveying belt 31 as shown in FIG. 12, but if the contact portion of the sheet on the sheet conveying belt 31 is known beforehand, it is better to be applied to only the contact portion of the sheet.

At this time, the applied voltage may be applied to all the area of the conveyance direction from one of the electric charging rollers and applied to only the contact portion of the sheet from the other electric charging roller, or the applied voltage from both of electric charging rollers 39*a* and 39*b* may be applied to only the contact portion of the sheet.

Figure 13A:
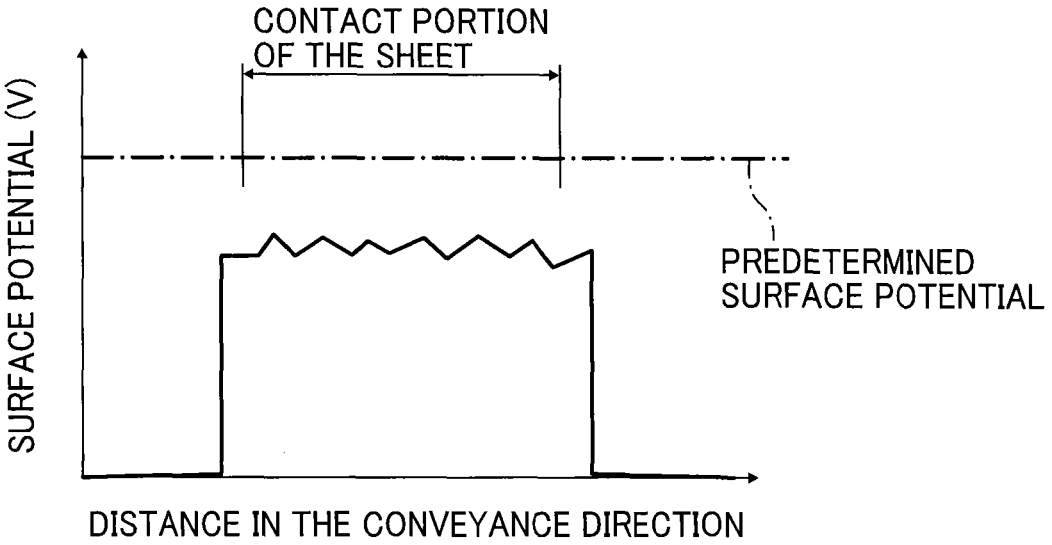
FIGS. 13A and 13B are charts illustrating the surface potential when charged by controlling the charging area according to one embodiment of the present disclosure.
Figure 13B:
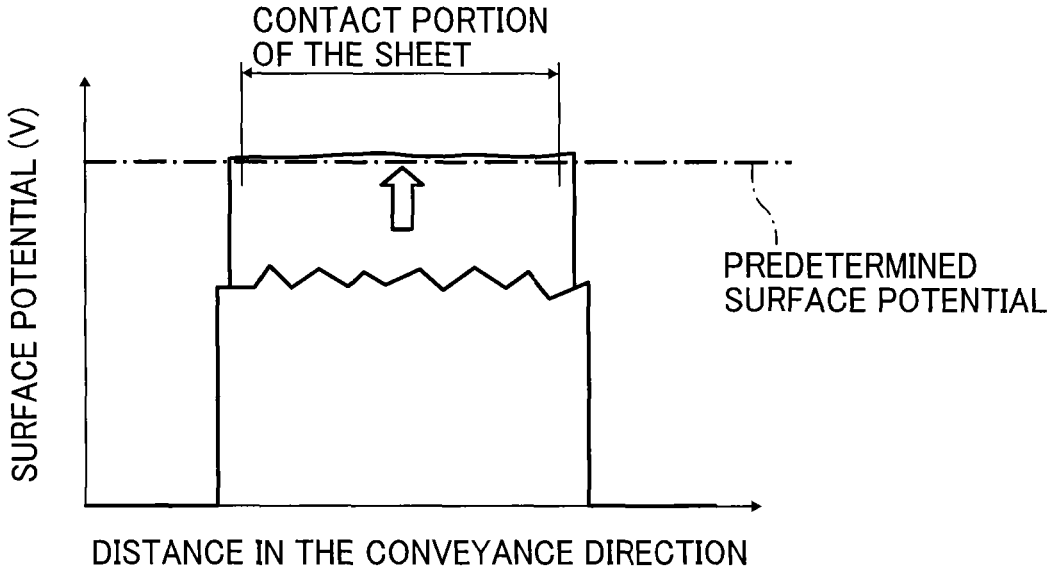

In fact, in consideration of the gap between areas of voltage applied by the electric charging roller 39*a* or 39*b*, and the contact portion of the sheet, etc., it is desirable to consider the relation of the width of the contact portion of the sheet, the area of voltage applied by the electric charging roller 39*a*, and the area of voltage applied by the electric charging roller 39*b* as: "the contact portion of the sheet <area of voltage applied by the electric charging roller 39*a*<area of voltage applied by the electric charging roller 39*b*," as shown in FIG. 13.

In the present disclosure, the material of the sheet is not limited to just paper and rather includes an OHP (overhead projector) sheet, cloth, glass, and a baseboard or the like. Further, the sheet includes material capable of attracting an ink drop and the other liquid or the like, such as a direct printing medium, an indirect printing medium, a printing sheet, a printing form, etc. Further, it is noted that image formation, recording, printing, imaging, and duplicating are used interchangeably.

It is also noted that the image forming apparatus represents a system that executes image formation by ejecting droplets onto a medium made of such as paper, yarn, fiber, fabric, leather, metal, plastic, glass, wood, ceramics, etc. It is also noted that the image formation onto the medium represents not only simply providing a meaningful image, such as a character, a figure, etc., but also a meaningless image such as simply landing droplets on the medium, etc.

It is also noted that the ink is not particularly limited to so-called ink unless particularly so described, and includes a DNA sample, resist, pattern material, and resin or the like. Specifically, the ink is a general term that represents liquid capable of forming an image, such as so called printing liquid, fixing operation processing liquid, ordinary liquid, etc.

Further, the image forming apparatus includes both a serial type image forming apparatus and a line type image forming apparatus unless otherwise specifically limited to one of them.

According to one aspect of the present disclosure, a surface potential required for absorption of a conveying belt can be kept high even if under a low-temperature and low-humidity environment. That is, a sheet conveying device includes a conveying member that adsorbs a sheet by an electric charge electrified on a surface, and conveys the sheet in a prescribed conveying direction; a first electric charger to charge the conveying member by applying voltage; a second electric charger to charge the conveying member by applying voltage. The second electric charger is arranged downstream from the first electric charger in the conveying direction, and applies the electric charge with the same polarity as the first electric charger to the conveying member.

According to another aspect of the present disclosure, a power supply voltage that forms required surface potential can be reduced. That is, at least a contact portion of the first electric charger or the second electric charger, which contacts with the conveying member, consists of a conductive material that has a fixed resistance, and a resistance of the contact portion of the first electric charger is lower than a resistance of the contact portion of the second electric charger.

According to yet another aspect of the present disclosure, a surface potential can be brought close to a required surface potential in any environment. That is, a variable resistor is arranged on an electric supply wiring between the first electric charger and a power supply.

According to yet another aspect of the present disclosure, a surface potential can be more effectively brought close to a required surface potential in any environment. That is, a resistance of a variable resistor is controlled so that a surface potential that is made with an electric charge charged by the first charger becomes smaller than a surface potential of the conveying member required finally for adsorption of the sheet.

Numerous additional modifications and variations of the present disclosure are possible in light of the above teachings. It is therefore to be understood that within the scope of the appended claims, the present disclosure may be executed otherwise than as specifically described herein. For example, the image forming apparatus is not limited to the above described various embodiments and may be altered as appropriate.

The invention claimed is:

1. A sheet conveying device, comprising:

a conveying member that adsorbs a sheet by an electric charge electrified on a surface, and conveys the sheet in a prescribed conveying direction;

a first electric charger to charge the conveying member by applying voltage; and a second electric charger to charge the conveying member by applying voltage, wherein the second electric charger is arranged downstream from the first electric charger in the conveying direction, and the second electric charger applies the electric charge with the same polarity as the electric charge applied by the first electric charger at a position of the conveying member that faces the second electric charger, such that the conveying member is charged with the same polarity.

2. The sheet conveying device as claimed in claim 1, wherein at least a contact portion of the first electric charger or the second electric charger, which contacts the conveying member, consists of a conductive material that has a fixed resistance, and a resistance of the contact portion of the first electric charger is lower than a resistance of the contact portion of the second electric charger.

3. The sheet conveying device as claimed in claim 1, wherein a variable resistor is arranged on an electric supply wiring between the first electric charger and a power supply.

4. The sheet conveying device as claimed in claim 3, wherein a resistance of the variable resistor is controlled so that a surface potential that is made with the electric charge charged by the first charger becomes smaller than a surface potential of the conveying member required for adsorption of the sheet.

5. An image forming apparatus, comprising:

a printing device that forms an image on a printing medium;

a conveying member that adsorbs the printing medium by an electric charge electrified on a surface, and conveys the printing medium with the image in a prescribed conveying direction;

a first electric charger to charge the conveying member by applying voltage;

a second electric charger to charge the conveying member by applying voltage; and a sheet feeding device that feeds the printing medium to the electrified conveying member, wherein the second electric charger is arranged downstream from the first electric charger in the conveying direction, and the second electric charger applies the electric charge with the same polarity as the electric charge applied by the first electric charger at a position of the conveying member that faces the second electric charger, such that the conveying member is charged with the same polarity.

6. The image forming apparatus as claimed in claim 5, wherein at least a contact portion of the first electric charger or the second electric charger, which contacts the conveying member, consists of a conductive material that has a fixed resistance, and a resistance of the contact portion of the first electric charger is lower than a resistance of the contact portion of the second electric charger.

7. The image forming apparatus as claimed in claim 5, wherein a variable resistor is arranged on an electric supply wiring between the first electric charger and a power supply.

8. The image forming apparatus as claimed n claim 7, wherein a resistance of the variable resistor is controlled so that a surface potential that is made with the electric charge charged by the first charger becomes smaller than a surface potential of the conveying member required for adsorption of the printing medium.

9. A sheet conveying device, comprising:

a conveying member that adsorbs a sheet by an electric charge electrified on a surface, and conveys the sheet in a prescribed conveying direction;

a first electric charger to charge the conveying member by applying voltage; and a second electric charger to charge the conveying member by applying voltage, wherein the second electric charger is arranged downstream from the first electric charger in the conveying direction, and applies the electric charge with the same polarity as the first electric charger, to the conveying member, and wherein a variable resistor is arranged on an electric supply wiring between the first electric charger and a power supply.

* * * * *